US009279384B2

(12) United States Patent
Dugad et al.

(10) Patent No.: US 9,279,384 B2
(45) Date of Patent: Mar. 8, 2016

(54) SEALING SYSTEM FOR AN ENGINE

(71) Applicant: DEERE & COMPANY, Moline, IL (US)

(72) Inventors: Arpita Dugad, Indore (IN); Umesh A Tol, Cedar Falls, IA (US); Paul M Wynthein, Waterloo, IA (US)

(73) Assignee: DEERE & COMPANY, Moline, IL (US)

( * ) Notice: Subject to any disclaimer, the term of this patent is extended or adjusted under 35 U.S.C. 154(b) by 183 days.

(21) Appl. No.: 14/056,056

(22) Filed: Oct. 17, 2013

(65) Prior Publication Data

US 2015/0107548 A1 Apr. 23, 2015

(51) Int. Cl.

| | |
|---|---|
| ***F02B 3/00*** | (2006.01) |
| ***F02F 11/00*** | (2006.01) |
| ***F02M 55/00*** | (2006.01) |

(52) U.S. Cl.

CPC ..... *F02F 11/002* (2013.01); *F02M 55/00* (2013.01); *F02M 55/005* (2013.01); *F02M 2200/16* (2013.01)

(58) Field of Classification Search

CPC .. F02B 3/06; F02B 2075/125; F02B 2275/14; F02B 1/12; F02B 23/104

USPC ..... 123/294

See application file for complete search history.

(56) References Cited

U.S. PATENT DOCUMENTS

| | | | | |
|---|---|---|---|---|
| 2003/0011193 | A1* | 1/2003 | Augustin | 285/302 |
| 2011/0174272 | A1 | 7/2011 | Male | |
| 2012/0006299 | A1 | 1/2012 | Worthington et al. | |

FOREIGN PATENT DOCUMENTS

| | | | |
|---|---|---|---|
| DE | 4427717 | C1 | 8/1995 |
| FR | 2869367 | A1 | 10/2005 |

OTHER PUBLICATIONS

European Search Report issued in counterpart application No. 14183056.2, dated Feb. 24, 2015 (4 pages).

* cited by examiner

*Primary Examiner* — Lindsay Low
*Assistant Examiner* — Charles Brauch

(57) ABSTRACT

A sealing system comprising a cylinder head, a coupler, a fuel injector line, a seal retainer, and a seal. The coupler is positioned in the cylinder head, and the fuel injector line extends into the coupler so as to at least partially define a fuel leak passageway therebetween. The seal retainer yieldably urges the seal towards a seated position in which the seal established a sealed connection between the fuel injector line and the coupler, so as to block ingress of moisture into the fuel leak passageway. Further, the seal retainer allows movement of the seal away from the seated position to an unseated position in which the sealed connection between the fuel injector line and the coupler is broken in response to pressurized leaked fuel, in the fuel leak passageway, so as to allow the pressurized leaked fuel to flow out of the fuel leak passageway.

20 Claims, 5 Drawing Sheets

SEALING SYSTEM FOR AN ENGINE

FIELD OF THE DISCLOSURE

The present disclosure relates to a sealing system for an engine.

SUMMARY OF THE DISCLOSURE

Disclosed is a sealing system comprising a cylinder head, a coupler, a fuel injector line, a seal retainer, and a seal. The coupler is positioned in the cylinder head, and the fuel injector line extends into the coupler so as to at least partially define a fuel leak passage therebetween. The seal retainer yieldably urges the seal towards a seated position in which the seal established a sealed connection between the fuel injector line and the coupler, so as to block ingress of moisture into the fuel leak passageway. Further, the seal retainer allows movement of the seal away from the seated position to an unseated position in which the sealed connection between the fuel injector line and the coupler is broken in response to pressurized leaked fuel in the fuel leak passageway, so as to allow the pressurized leaked fuel to flow out thereof.

By using the seal to prevent the ingress of moisture from the outside environment, rust is less likely to form and block the fuel leak passageway. Otherwise, if the fuel leak passageway did happen to become blocked, as the result of rust, then cracking of the cylinder head could occur. Ultimately, via the disclosed sealing system, the seal retainer and the seal cooperate, so as to provide significant resistance to the ingress of moisture from the outside environment (i.e., rust prevention), but minimal resistance to the egress of leaked fuel to the outside environment (i.e., fuel leak passageway to the outside environment).

BRIEF DESCRIPTION OF THE DRAWINGS

The detailed description of the drawings refers to the accompanying figures in which.

DETAILED DESCRIPTION OF THE DRAWINGS

Figure 1:
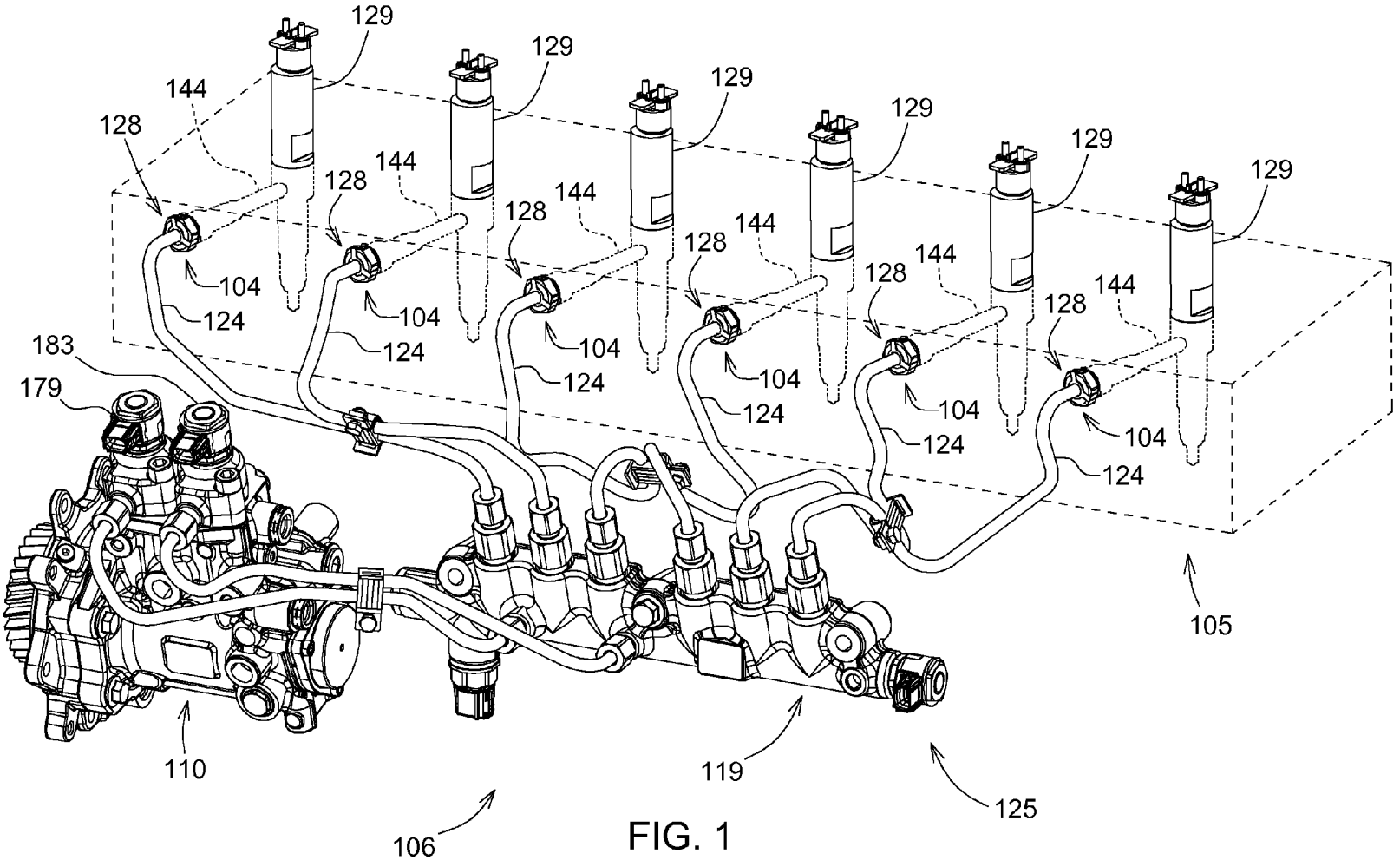
FIG. 1. is a perspective view of a fuel system of an engine, the view further showing a sealing system.
Figure 2:
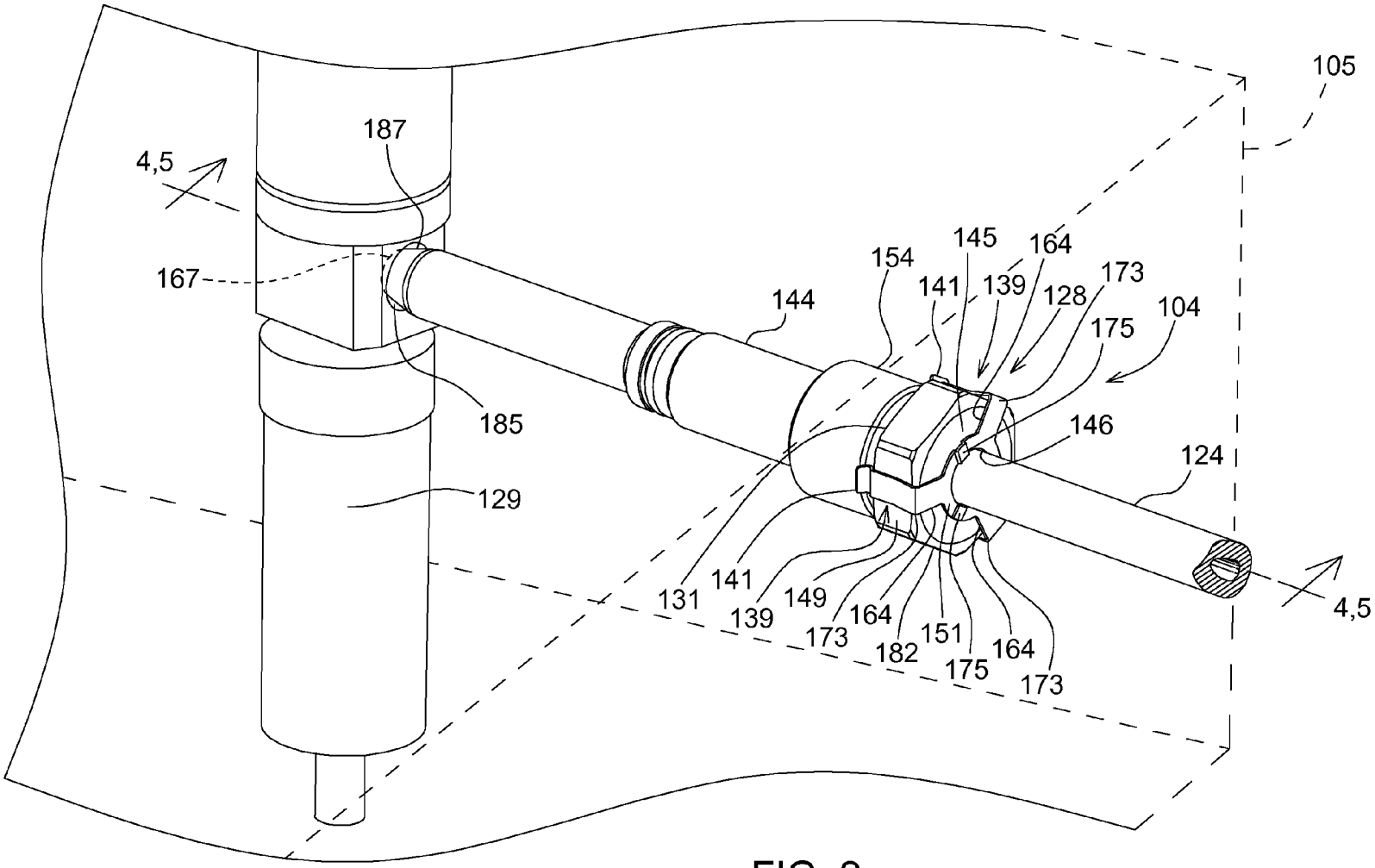
FIG. 2 is a perspective view of the sealing system, showing a side feed tube, a fuel injector line, and a seal retainer.

Referring to FIG. 1, there is shown a schematic illustration of an engine 106 for providing power to a variety of machines, including on-highway trucks, construction vehicles, marine vessels, stationary generators, automobiles, agricultural vehicles, and recreation vehicles. The engine 106 may be any kind of engine that produces an exhaust gas, such as, for example, an internal combustion engine, such as a gasoline engine; a diesel engine; a gaseous fuel burning engine, such as a natural gas engine; or any other kind of exhaust gas producing engine. Further, the engine 106 may be of any size, with any number cylinders (not shown), and in any configuration (e.g., "V," inline, and radial). And the engine 106 may include various sensors, such as temperature sensors, pressure sensors, and mass flow sensors. The engine control unit (ECU), not shown, is the brain or the master controller of the engine 106. Functions of the ECU include controlling a fuel system 125 and providing the operator or technician diagnostic information.

A gear train (not shown) of the engine 106 drives a high pressure fuel pump 110, such as a Denso fuel pump. During operation, the fuel pump 110 delivers pressurized fuel to a common rail 119, assuming that at least one of selective control valves 179, 183 is open. The common rail 119 acts as an accumulator for maintaining a constant fuel pressure in a plurality of fuel injector lines 124. Further, the common rail 119 provides a leak off location; allows for the fuel pump 110 to have just one or two outlets, rather than six (one for each of a plurality of fuel injectors 129); and acts as an accumulator for maintaining a constant pressure in the fuel system 125.

Next, the injector lines 124 route the fuel from the common rail 119 to the fuel injectors 129, which are calibrated so to discharge a required amount of fuel, at a required time, to the combustion chambers (not shown). To do this, the fuel injectors 129 cooperate with a controller, such as the ECU, for example. Among other things, the fuel system 125 provides variable timing control for improved emissions and better control at the start of fuel injection for improved starting.

Referring to FIGS. 2-5, the sealing system 104 comprises a cylinder head 105, a coupler 138, the injector line 124, a seal retainer 128, and a seal 162. The coupler 138 is positioned in the cylinder head 105, and the injector line 124 extends into the coupler 138 so as to at least partially define a fuel leak passageway 142 therebetween. The seal retainer 128 yieldably urges the seal 162 towards a seated position (see FIG. 4) in which the seal 162 established a sealed connection between the injector line 124 and the coupler 138, so as to block ingress of moisture (see the arrows and droplets 148) into the fuel leak passageway 142.

Further, the seal retainer 128 allows movement of the seal 162 away from the seated position to an unseated position (see FIG. 5) in which the sealed connection between the injector line 124 and the coupler 138 is broken in response to pressurized leaked fuel (see the arrows and droplets 160), in the fuel leak passageway 142, so as to allow the pressurized leaked fuel to flow out of the fuel leak passageway 142. In some cases, the seal retainer 128 and the seal 162 may pop completely off of the coupler 138 in response to the pressurized leaked fuel.

The coupler 138 comprises a nut 154, the nut 154 being threaded into the cylinder head 105. Although a portion of the nut 154 is shown as having six sides, in other embodiments it could have greater or fewer sides, depending on the specific application and the shape of the seal retainer 128. In the embodiment shown, the seal 162 (e.g., an o-ring) seats against the nut 154 when in the seated position, or more specifically, the seal 162 seats against a chamfer 171 of the nut 154. Having the seal 162 in the seated position prevents the ingress of moisture into the fuel leak passageway 142 from the outside environment. Without the seal 162, significant amounts of moisture (e.g., from a power washer) could accumulate in the fuel leak passageway 142 and cause the formation of rust on, for example, a side feed tube 144, the side feed tube 144 being positioned in the cylinder head 105 and downstream of the injector line 124. The formation of rust could block the egress of fuel from the fuel leak passageway 142, and potentially lead to the development of cracks in the cylinder head 105, a phenomenon known as cylinder head structural failure.

The aforementioned issues are avoided, however, because (as discussed) the seal 162 blocks the ingress of moisture when in the seated position—thereby preventing the formation of rust—and it also allows the egress of leaked fuel when in the unseated position—thereby allowing leaked fuel to flow through the fuel leak passageway 142. Such an arrangement results in minimal resistance to the egress of leaked fuel to the outside environment, but significant resistance to the ingress of moisture from the outside environment.

The seal retainer 128 comprises a biasing plate 151 comprising an aperture 146, the aperture 146 being positioned so as to receive the injector line 124. As illustrated, the biasing plate 151 may be disc shaped, but it could also be octogonally shaped, for example, so as to mirror the shape of the face surface 145 of the nut 154. The biasing plate 151 further comprises a release notch 175 that is positioned at an outer portion of the biasing plate 151 and that is raised away from the coupler 138, thereby providing a servicing location for removing the seal retainer 128. The illustrated embodiment shows three release notches 175, but other embodiments could have greater or fewer thereof. The seal retainer 128 may be formed out of spring steel and be heat treated, giving the seal retainer 128 elastic properties for allowing the seal 162 to move between the seated position and the unseated position. Further, the seal retainer 128 may be formed from a plate by making die cuts and bends thereto.

As illustrated, the injector line 124 is sandwiched between the coupler 138 and the side feed tube 144, and the side feed tube 144 is sandwiched between the injector line 124 and the cylinder head 105. The side feed tube 144 extends through an o-ring 143. The cylinder head 105 and the side feed tube 144 define a first portion 153 of the fuel leak passageway 142 therebetween, the side feed tube 144 and the coupler 138 define a second portion 155 of the fuel leak passageway 142 therebetween, and the injector line 124 and the coupler 138 define a third portion 157 of the fuel leak passageway 142 therebetween. The first portion 153 is positioned upstream of the second portion 155, and the second portion 155 is positioned upstream of the third portion 157. The first, second, and third portions 153, 155, 157 allow the leaked fuel to flow therethrough and past the seal 162 when it is in the unseated position.

Figure 3:
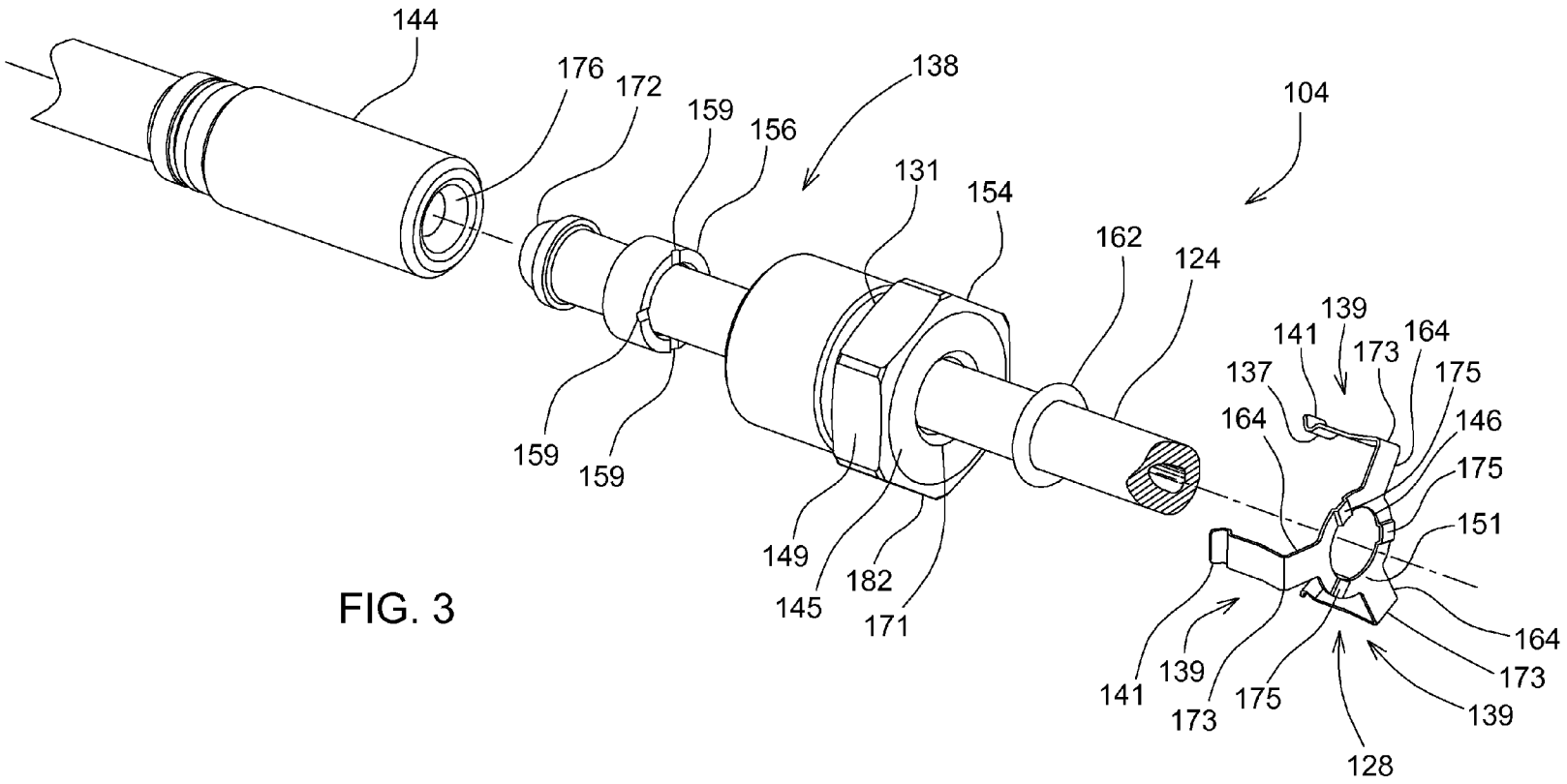
FIG. 3 is an exploded perspective view of the sealing system, showing the side feed tube, the fuel injector line, the seal retainer, and a seal.
Figure 4:
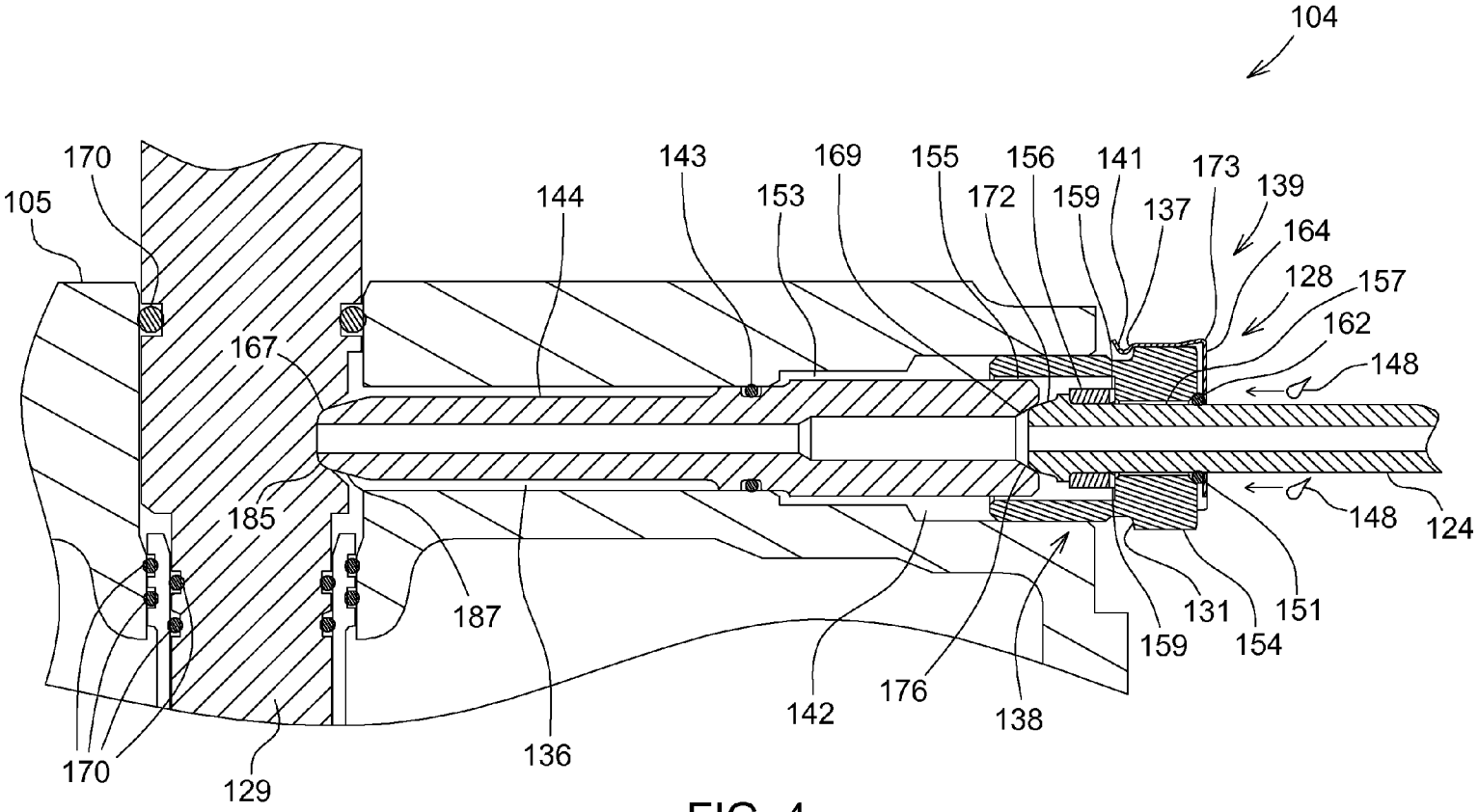
FIG. 4 is a sectional view of the sealing system taken along line 4-4 of FIG. 2, showing the seal in a seated position, blocking the ingress of moisture.
Figure 5:
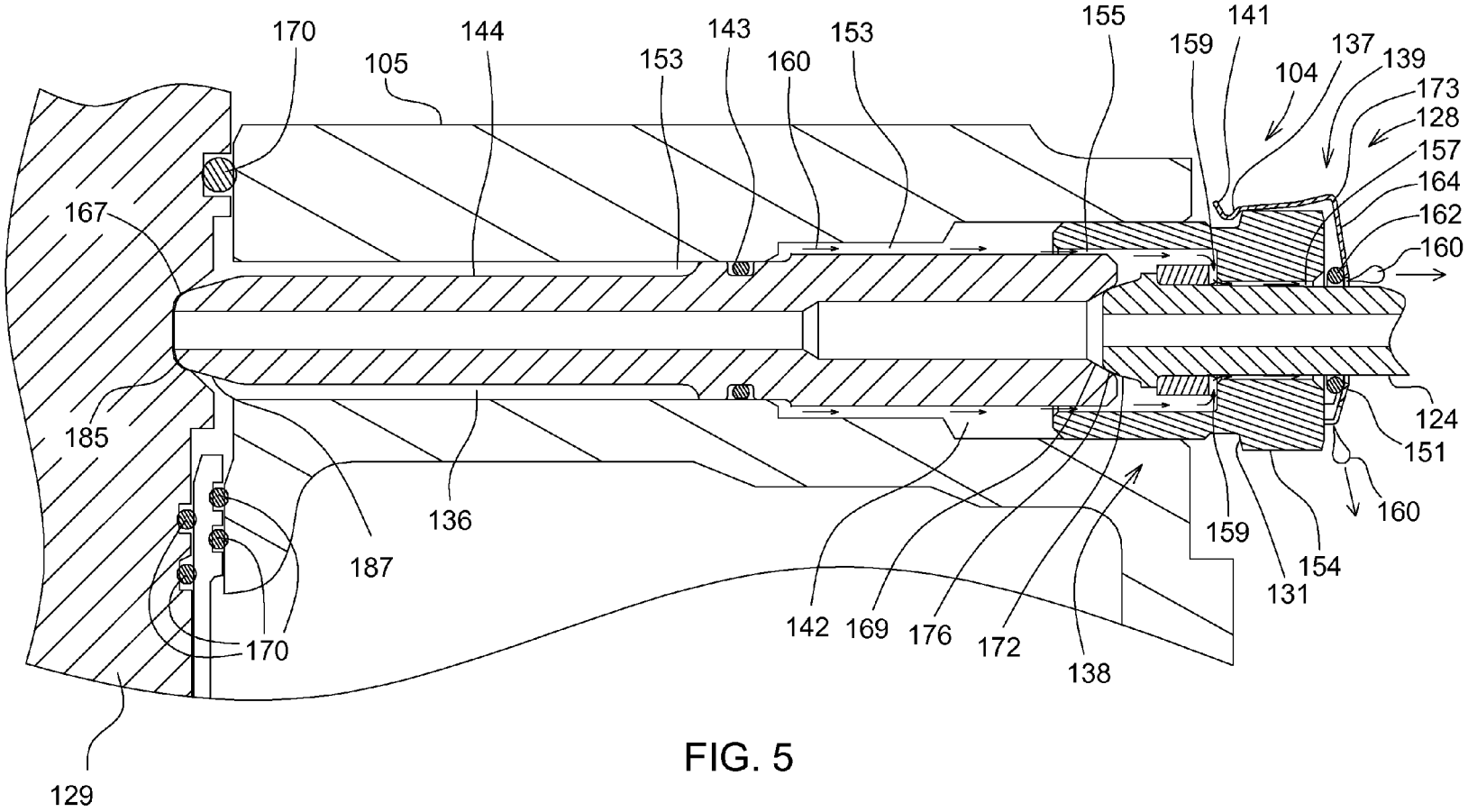
FIG. 5 is a sectional view of the sealing system taken along lines 5-5 of FIG. 2, showing the seal in an unseated position, allowing the egress of fuel to the outside environment.

Referring to FIGS. 3-4, the leaked fuel flowing through the fuel leak passageway 142 emanates from first junction 169 (see the arrows and droplets 160 in FIG. 5). The first junction 169 is positioned between the side feed tube 144 and the injection line 124. The side feed tube 144 has an inwardly and conically shaped end 176 (i.e., hallow portion) for accommodating an outwardly and conically shaped end 172 (i.e., solid portion) of the injection line 124, so as to form the first junction 169. As shown, the first junction 169 forms between the injection line 124 and the side feed tube 144 when the conically shaped ends 172, 176 are joined, thereby providing a circumferential sealing effect. There can be a risk of high pressure fuel leaks at the first junction 169 due to improper sealing (i.e., insufficient torque or axial force), and in such cases, high pressure fuel leaks into the fuel leak passageway 142. The discharge or leakage of fuel, from the engine 106 and specifically from the fuel leak passageway 142, indicates to the operator of the engine 106 that a service operation may be necessary.

In addition, a second junction 167 is positioned between the side feed tube 144 and the fuel injector 129. The fuel injector 129 has an inwardly and conically shaped end 185 (i.e., hallow portion) for accommodating an outwardly and conically shaped end 187 (i.e., solid portion) of the side feed tube 144. As shown, the second junction 167 forms between the fuel injector 129 and the side feed tube 144 when the conically shaped ends 185, 187 are joined, thereby providing a circumferential sealing effect. Every time the fuel injector 129 is actuated and the plunger pushes fuel to a tip of the fuel injector 129, a small amount of fuel, referred to as injector leak-off fuel, leaks past a plunger from a region of high pressure to a region of low pressure. Injector leak-off fuel is confined by a plurality of o-rings 170 to an injector leak-off passageway between the fuel injector 129 and the cylinder head 105. The leak-off fuel flows into the injector leak-off passageway 136 between the side feed tube 144 and the cylinder head 105, and then it flows out of the cylinder head 105 and into passages in the rocker shaft carrier housing (not shown). The o-ring 143 and the plurality of o-rings 170 prevent the injector leak-off fuel from leaking out of the cylinder head engine 106.

The coupler 138 may further comprise a sleeve 156, wherein the injector line 124 extends through the sleeve 156 and the nut 154. The sleeve 156 comprises a slot 159 extending radially through the sleeve 156. The slot 159 is included in the fuel leak passageway 142 and fluidly connects the second portion 155 and the third portion 157 of the fuel leak passageway 142.

The seal retainer 128 comprises a biasing plate 151 and a plurality of mounting tabs 139 extending therefrom and positioned about the coupler 138. The biasing plate 151 comprises an aperture 146 that receives the injector line 124. The seal 162 is positioned between the biasing plate 151 and the coupler 138. The biasing plate 151 and the mounting tabs 139 cooperate so as to flex, allowing the seal 162 to move between the seated position (see FIG. 4) and the unseated position (see FIG. 5). The illustrated embodiment shows three mounting tabs 139, but other embodiments could have greater or fewer mounting tabs 139, given the shape of the nut 154, for example.

As shown in FIG. 4, for example, each of the mounting tabs 139 comprises an overlapping portion 164, each of which overlaps a face surface 145 and a side surface 149 of the coupler 138. Further, each of the overlapping portions 164 forms a bend 173 about an edge 182 of the coupler 138 formed at a junction of the face surface 145 and the side surface 149. Each of the mounting tabs 139 comprises a bend 173, each bend 173 being positioned radially outwards relative to the face surface 145 so as to form an acute angle. The bends 173 are configured to flex, thereby allowing the seal 162 to move between the seated position and the unseated position.

The mounting tabs 139 are approximately evenly spaced relative to one another about the coupler 138. Each of the mounting tabs 139 comprises an inward bend 137 extending radially inwards and wrapping around a retaining edge 131 of the coupler 138, causing the inward bends 137 to retain the seal retainer 128 to the coupler 138. Additionally, each of the mounting tabs 139 comprises an outward bend 141 extending radially outward and away from the inward bend 137. The outward bend 141 provides a servicing location for installing the seal retainer 128. As shown, the inward bend 137 is positioned between the biasing plate 151 and the outward bend 141.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A sealing system, comprising:

a cylinder head;

a coupler positioned in the cylinder head, the coupler comprising a nut with a chamfer;

a fuel injector line extending into the coupler so as to at least partially define a fuel leak passageway therebetween;

a seal retainer; and a seal, wherein the seal retainer yieldably urges the seal toward a seated position against the chamfer in which the seal establishes a sealed connection between the fuel injector line and the coupler so as to block ingress of moisture into the fuel leak passageway.

2. The sealing system of claim 1, wherein the seal is an O-ring, and the O-ring surrounds the fuel injector line.

3. The sealing system of claim 1, wherein the seal retainer further comprises a biasing plate, the biasing plate further comprises an aperture and a release notch, the aperture receives the fuel injector line, and the release notch is positioned at an outer portion of the biasing plate and is raised away from the coupler, so as to provide a servicing location for removing the seal retainer.

4. The sealing system of claim 1, wherein the seal retainer further comprises a biasing plate that yieldably urges the seal towards the coupler, and the biasing plate further comprises an aperture that receives the fuel injector line.

5. The sealing system of claim 1, wherein the coupler further comprises a sleeve, the fuel injector line extends through the sleeve and the nut, and the sleeve further comprises a slot extending radially through the sleeve and included in the fuel leak passageway.

6. The sealing system of claim 1, wherein the seal retainer allows movement of the seal away from the seated position to an unseated position in which the sealed connection between the fuel injector line and the coupler is broken in response to pressurized leaked fuel, in the fuel leak passageway, so as to allow the pressurized leaked fuel to flow out of the fuel leak passageway.

7. The sealing system of claim 6, wherein the seal retainer further comprises a biasing plate, the seal is positioned away from the nut but against the biasing plate when in the unseated position, and the seal is positioned against the nut and the biasing plate when in the seated position.

8. The sealing system of claim 6, wherein the seal retainer is formed out of spring steel and heat treated, so as to give the seal retainer elastic properties for allowing the seal to move between the seated position and the unseated position.

9. The sealing system of claim 6, further comprising a side feed tube positioned in the cylinder head and positioned downstream of the fuel injector line, the cylinder head and the side feed tube defining a first portion of the fuel leak passageway therebetween, and the first portion being configured to allow the leaked fuel to flow therethrough and past the seal when the seal is in the unseated position.

10. The sealing system of claim 9, wherein the leaked fuel flowing through the fuel leak passageway emanates from a junction between the side feed tube and the fuel injector line.

11. The sealing system of claim 9, wherein the side feed tube and the coupler define a second portion of the fuel leak passageway therebetween, the first portion is positioned upstream of the second portion, and the second portion is configured to allow the leaked fuel to flow therethrough and past the seal when the seal is in the unseated position.

12. The sealing system of claim 11, wherein the fuel injector line and the coupler define a third portion of the fuel leak passageway therebetween, the second portion is positioned upstream of the third portion, and the third portion is configured to allow the leaked fuel to flow therethrough and past the seal when the seal is in the unseated position.

13. The sealing system of claim 12, wherein the coupler further comprises a sleeve, the fuel injector line extends through the sleeve and the nut, the sleeve further comprises a slot extending radially through the sleeve and included in the fuel leak passageway, and the slot fluidly connects the second portion and the third portion of the fuel leak passageway.

14. The sealing system of claim 6, wherein the seal retainer further comprises a biasing plate and a plurality of mounting tabs extending therefrom and positioned about the coupler, the biasing plate further comprises an aperture that receives the fuel injector line, the seal is positioned between the biasing plate and the coupler, and the biasing plate and the plurality of mounting tabs cooperate so as to flex, allowing the seal to move between the seated position and the unseated position.

15. The sealing system of claim 14, wherein the mounting tabs are approximately evenly spaced relative to one another about the coupler.

16. The sealing system of claim 14, wherein at least one of the mounting tabs further comprises an inward bend extending radially inwards and wrapping around a retaining edge of the coupler, and the inward bend is configured to retain the seal retainer to the coupler.

17. The sealing system of claim 16, wherein the at least one of the mounting tabs further comprises an outward bend extending radially outward and away from the inward bend, the outward bend is configured to provide a servicing location for installing the seal retainer, and the inward bend is positioned between the biasing plate and the outward bend.

18. The sealing system of claim 14, wherein each of the plurality of mounting tabs further comprises an overlapping portion, each of the overlapping portions overlaps a face surface of the coupler and a side surface of the coupler, and each of the overlapping portions forms a bend about an edge of the coupler formed at a junction of the face surface and the side surface.

19. The sealing system of claim 18, wherein each bend is positioned radially outwards relative to the face surface so as to form an acute angle, and each bend is configured to flex, so as to allow the seal to move between the seated position and the unseated position.

20. A sealing system, comprising:

a cylinder head;

a coupler positioned in the cylinder head, the coupler comprising a nut;

a fuel injector line extending into the coupler so as to at least partially define a fuel leak passageway therebetween;

a seal retainer comprising a biasing plate; and a seal, wherein:

the seal retainer yieldably urges the seal toward a seated position in which the seal establishes a sealed connection between the fuel injector line and the coupler so as to block ingress of moisture into the fuel leak passageway, and the seal is positioned against the nut and the biasing plate when in the seated position, the seal retainer allows movement of the seal away from the seated position to an unseated position in which the sealed connection between the fuel injection line and the coupler is broken in response to pressurized leaked fuel, in the fuel leak passageway, so as to allow the pressurized leaked fuel to flow out of the fuel leak passageway, and the seal is positioned away from the nut but against the biasing plate when in the unseated position.

* * * * *